United States Patent [19]

Tronchon

[11] Patent Number: 4,466,685

[45] Date of Patent: Aug. 21, 1984

[54] COAXIAL CONNECTOR ELEMENT

[75] Inventor: Christian Tronchon, Voiron, France

[73] Assignee: S.A. Radiall, Rosny-Sous-Bois, France

[21] Appl. No.: 265,434

[22] Filed: May 20, 1981

[30] Foreign Application Priority Data

May 23, 1980 [FR] France ..... 80 11578

[51] Int. Cl.[3] ..... H01R 17/18

[52] U.S. Cl. ..... 339/177 R; 339/258 RR; 29/520; 29/882

[58] Field of Search ..... 339/177 R, 177 E, 217 R, 339/217 S; 29/517, 520, 882

[56] References Cited

U.S. PATENT DOCUMENTS

| | | | |
|---|---|---|---|
| 3,055,100 | 9/1962 | Kimpel | 29/520 |
| 3,416,125 | 12/1968 | Theve . | |
| 3,745,514 | 7/1973 | Brishka . | |
| 3,761,870 | 9/1973 | Drezin et al. . | |
| 3,936,125 | 2/1976 | Hutter | 339/177 E |
| 3,989,081 | 11/1976 | Sigmund | 29/520 |

FOREIGN PATENT DOCUMENTS

| | | |
|---|---|---|
| 2255135 | 5/1974 | Fed. Rep. of Germany . |
| 906396 | 1/1946 | France . |
| 7000070 | 10/1970 | France . |
| 7120515 | 1/1973 | France . |

*Primary Examiner*—Eugene F. Desmond
*Assistant Examiner*—David L. Pirlot
*Attorney, Agent, or Firm*—Lyon & Lyon

[57] ABSTRACT

A coaxial connector element including a tubular body having an internal cavity, a rod secured against axial motion in the tubular body by a bead made from a dielectric material, such as glass, the axial rod protruding from the tip of the tubular body closed by the bead, a central contact having an axial hollow for its engagement around the rod within the tubular body, and an insulator between the central contact and the wall of the internal cavity within the tubular body. The central contact has near its tip, engaged in the axial rod an annular shoulder which protrudes inwardly into the axial hollow provided in the central contact, the angular shoulder penetrating into the axial rod.

6 Claims, 10 Drawing Figures

COAXIAL CONNECTOR ELEMENT

BACKGROUND OF THE INVENTION

The present invention relates to a coaxial connector element and, more particularly, to a coaxial connector element of the direct sealing type, i.e., one comprising a tubular body having an inner cavity, a rod secured against axial motion in said body by a bead made from dielectric material, particularly glass, said axial rod protruding from the tip of said body closed by said bead, a central contact having an axial hollow for its engagement around said rod within said body, and an insulator between said central contact and the wall of the cavity within said body.

This type of connector element is generally employed in microelectronics for microwave applications, and they are usually assembled in a box, their axial rod being connected, in particular, to a printed circuit board.

In order to obtain satisfactory electrical properties on the central contact of such connector elements, the central contact must be secured against motion on the axial rod, in such a way that the electrical connection is made right next to the tip of the central contact installed around the axial rod, i.e., near the bead made from glass or from a similar material and closing the tip of the connector element and through which said axial rod protrudes outwardly. This is an area which is difficult to reach during the fabrication process and to date the problems relating to the mechanical and electrical connections between the central contact and the axial rod have not yet been totally and satisfactorily resolved, all the more because it is particularly important for the opposite tip of the central contact to be accurately positioned in relation to a mechanical transversal reference plane for the engagement of a complementary contact.

A first presently known method for securing the central contact against motion on the axial rod consists in positioning a soldered joint near the tip of the central contact. Because of the location of the area where the soldering must be effected, the soldering operation is, in fact, done blindly so that, in practice, it is difficult to have any control over the quality of the soldered joint. In addition, this soldered joint is unreliable since, while the connector element is in use, it must be able to withstand temperatures of over 250°, because usually the other end of the axial rod is soldered at temperatures exceeding 250° during the process of installing the connector element in a box.

A second presently known method is to use a mechanical means, such as a pair of pliers, in an attempt to secure the central contact against motion on the axial rod. This method is inadequate for securing the central contact against a translatory motion.

SUMMARY OF THE INVENTION

The object of this invention is to provide a connector element in which the central contact is efficiently securred on the axial rod against translatory as well as rotary motions, by mechanical means, without any heat being applied, and with the central contact being also perfectly positioned within the body of the connector element.

In addition, in the connector element embodying the invention, the central contact may be disassembled and replaced, if necessary, if it is defective, and the same characteristics may be obtained with a new contact.

The connector element according to the invention is essentially characterized in that its central contact has, near the tip engaged on said axial rod, an annular shoulder protruding inwardly into the axial hollow provided on the central contact, said annular shoulder penetrating into said rod.

DETAILED DESCRIPTION OF THE INVENTION

In a first embodiment of the invention, the axial rod has an annular groove in which to receive said shoulder. Advantageously, the central contact has a certain radial elasticity near its tip provided with the shoulder so as to permit the shoulder to engage click-wise in the annular groove of the rod. This radial elasticity is conferred upon the central contact by providing its tip with several longitudinal slots. For example, two or four of these slots may be provided.

In a second embodiment of the invention, the shoulder on the central contact is overlayed in the axial rod. This overlaying may be performed by pressing the central contact against the rod using a tubular part engaged around the central contact and capable of exerting thereon, in the area with the shoulder, circumferential forces directed inwardly against the rod. In a preferred embodiment, this annular part includes an internal cylindrical bearing surface abutting against the central contact and a truncated external bearing surface on which comes to slide a corresponding truncated bearing surface of a sleeve which engages externally around said part. Advantageously, said part has at its end, in front of said bearing surfaces, frontal bearing surfaces which abut against the inner bottom wall of the cavity of the body of the connector element in order to ensure the precise positioning of the shoulder of the central contact in relation to the axial rod.

In this second embodiment, it is likewise of advantage to confer a radial elasticity upon the tip of the central contact by providing slots as in the first embodiment described above.

The shoulder of the central contact is preferably provided at the bottom of a chamfer made in the tip face of this central contact. The shoulder may be provided by any means such as machining or, advantageously, by chasing with the aid of a tool with a conical tip and which engages in the chamfer and pushing back the central contact material until in inwardly projecting annular shoulder is obtained.

BRIEF DESCRIPTION OF THE DRAWINGS

Other objects and advantages of the invention will become apparent from the following description of the connector element embodying the invention and the accompanying drawing, in which.

DESCRIPTION OF THE PREFERRED EMBODIMENTS

Figure 1:
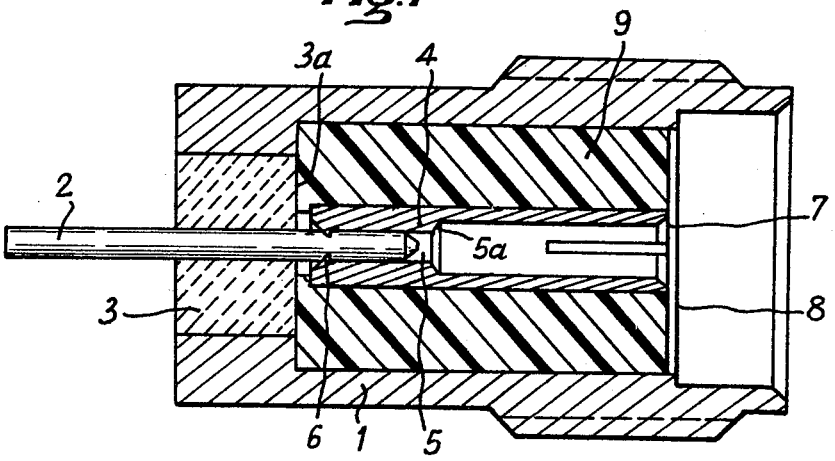
FIG. 1 is a longitudinal cross-sectional view of a connector element in accordance with the teachings of the invention.

FIG. 1 shows a connector element embodying the invention.

The connector element comprises a metallic body 1 in which a metallic rod 2 is secured against axial motion by means of a bead made from glass or a similar dielectric material 3 and which is fastened to the metallic parts. As apparent from FIG. 1, the axial rod 2 protrudes from the tip of the body which is closed by a glass bead 3.

According to the invention, a central contact 4 is secured against motion on the axial rod 2, said central contact having an axial hollow 5 formed of two sections with different diameters and separated by a truncated locating face 5*a* and, near its tip, an internal annular shoulder 6 which protrudes in the hollow 5 and penetrates, according to the invention, into the rod 2. The opposite tip 7 of the central conductor must be perfectly positioned in relation to a mechanical reference plane shown at 8. This positioning must be very accurate in order to obtain an optimum microwave electrical link with a complementary central contact (not shown) of a connector element designed for assembly with the connector element embodying the invention.

An insulator 9 is inserted between the central contact 4 and the wall of the central cavity of the body 1.

Figure 2:
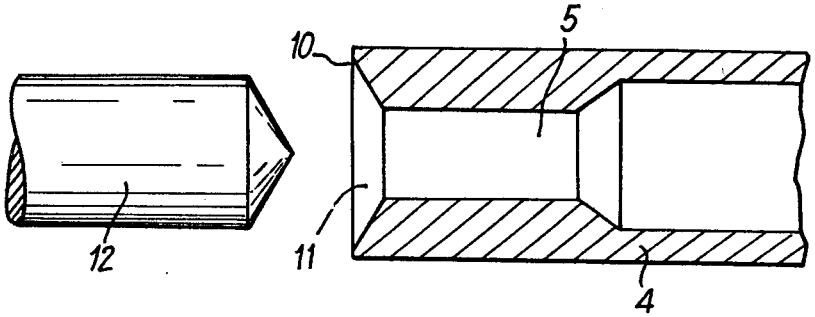
FIGS. 2 to 4 show a particular mode of preparing the tip of the central contact for obtaining the connector element according to FIG. 1.
Figure 3:
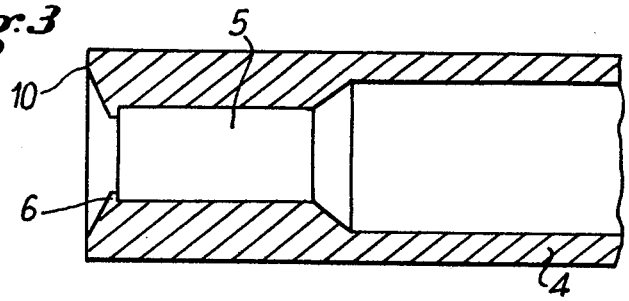
Figure 4:
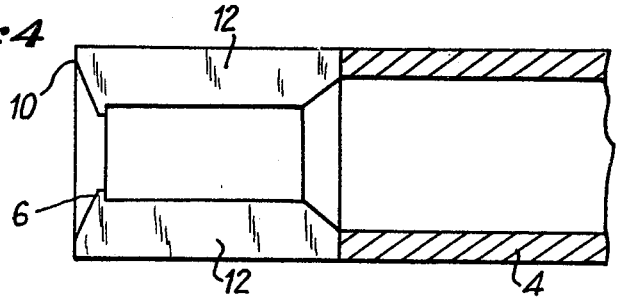

Referring now to FIGS. 2 to 4, in which a particular method of preparing the tip of the central contact 4 is described for realizing the connector element shown in FIG. 1.

After the internal hollow 5 of the contact 4 has been machined beforehand, a chamfer 11, e.g., with an angle of 120°, is machined in the surface of the tip 10 of the contact 4.

Then, a tool 12 with a conical tip and with an angle of 120°, or slightly less, is inserted into the chamfer 11 (FIG. 2). When this tool turns, it pushes back the material of the central contact 4 until an annular shoulder 6 is formed (FIG. 3) which protrudes into the hollow 5.

A plurality of longitudinal slots 12 (FIG. 4) are then made in a portion of the length of the central contact 4, starting from the face of the tip 10 so as to confer a certain radial elasticity upon the tip area of the central contact 4.

Figure 5:
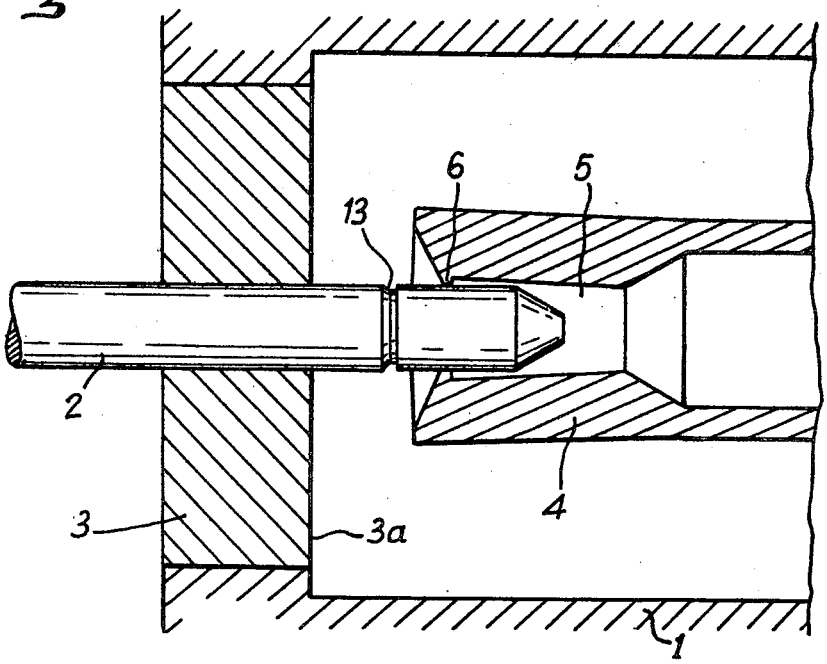
FIGS. 5 and 6 show two stages in the fabrication of the connector element according to a first embodiment of the invention.
Figure 6:
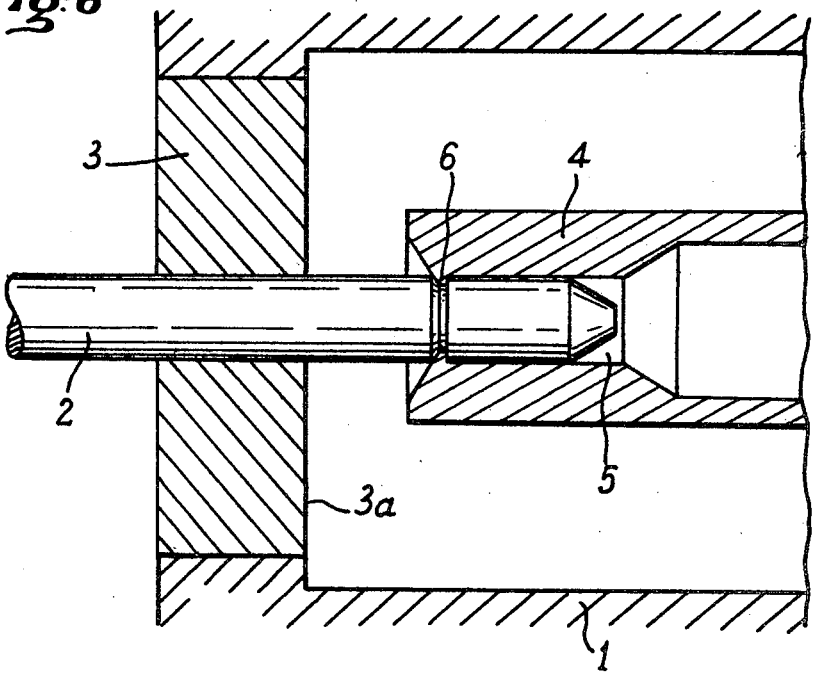

Referring now to FIGS. 5 and 6, in this first embodiment, the central contact 4 is entered on the tip of the rod 2 protruding into the internal cavity of the tubular body 1. As can be seen in FIG. 5, the rod 2 is provided with an annular groove 13 sized to receive the shoulder 6 of the central contact 4 (FIG. 6). In practice, because of the radial elasticity of the central contact 4, the latter is entered on the rod until the annular shoulder 6 engages click-wise in the groove 13 made on the circumference of the rod 2.

In a later phase not shown herein, in order to complete the connector element, the insulator 9 seen in FIG. 1 is entered around the central contact 4 in the internal cavity of the tubular body.

In this embodiment, all the manufacturing tolerances are referred to the positioning of the part 7 of the central contact in relation to the mechanical reference plane 8 and are essentially linked to the position of the groove 13 provided in the rod 2 in relation to the bottom wall of the internal cavity of the tubular body mainly defined by the internal surface 3*a* of the glass bead 3.

Figure 7:
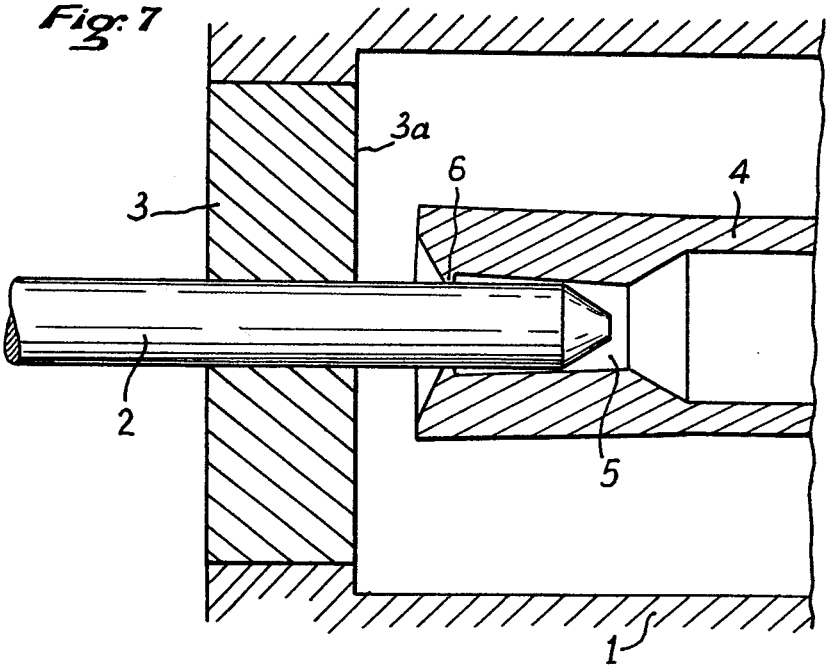
FIGS. 7 to 9 show two stages in the fabrication of a connector element according to a second embodiment of the invention.
Figure 8:
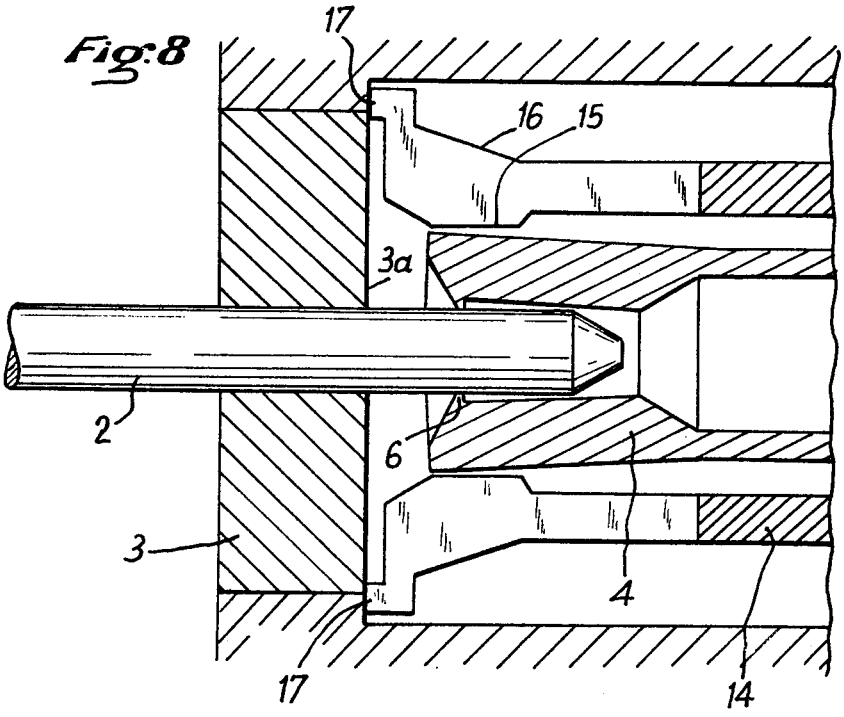
Figure 9:
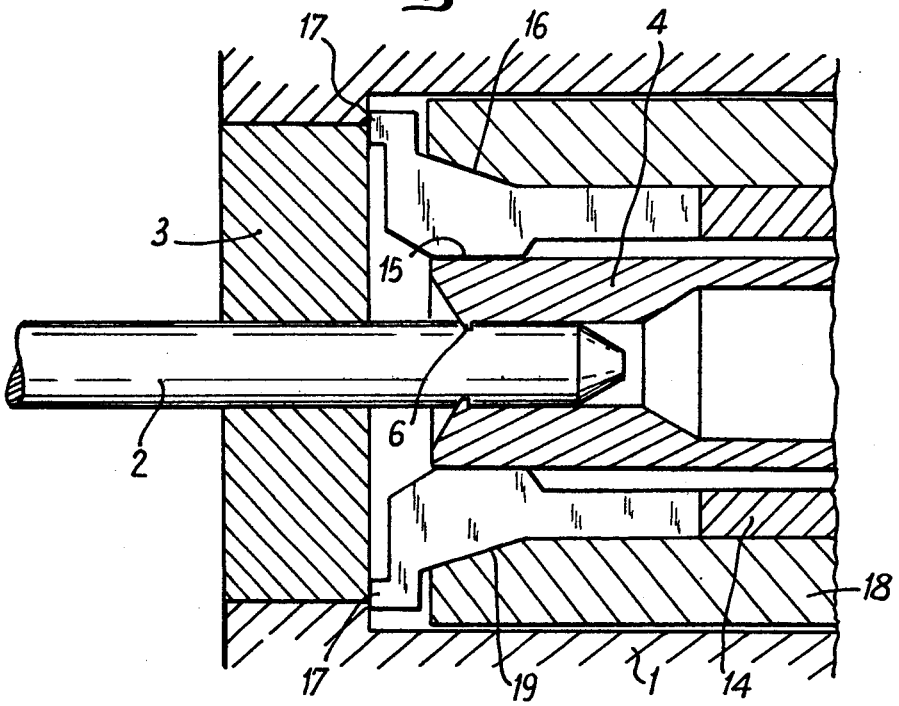

Referring now to FIGS. 7 to 9, which illustrate a a second embodiment of the connector element embodying the invention.

In this embodiment, the axial rod 2 does not have an annular groove as in the first embodiment. In order to realize the connector element according to the invention, the central contact 4 is first accurately positioned in relation to the body of the connector 1 at the level of the tip 7 of the central contact with respect to the mechanical reference plane 8. Then, a tubular part 14 is positioned around the central contact 4, which includes an internal cylindrical bearing surface 15 and a truncated external bearing surface 16 (FIG. 8). This tubular part 14 has longitudinal slots to enable it to deform radially. The tip of this tubular part 14 has furthermore, in front of the bearing surfaces 15 and 16, frontal bearing surfaces 17 abutting against the internal bottom wall of the central cavity of the body of the connector element.

Then, as shown in FIG. 9, a sleeve 18, the frontal side of which has a truncated bearing surface 19 corresponding to the truncated bearing surface 16 of the part 14, is inserted in the internal cavity of the body of the connector element around the part 14, the forward movement of the sleeve along the axis towards the bottom of the internal cavity of the body 1 generating circumferential forces which are directed radially inwardly into the central contact 4 and causing the annular shoulder 6 to dig itself in the external wall of the rod 2, thus creating an anchorage which resists the translatory and rotary motions of the central contact 4 in the rod 2.

The connector element is thereafter completed, after forcing off the sleeve 18, and then the part 14, by inserting an insulator 9 (FIG. 1).

Figure 10:
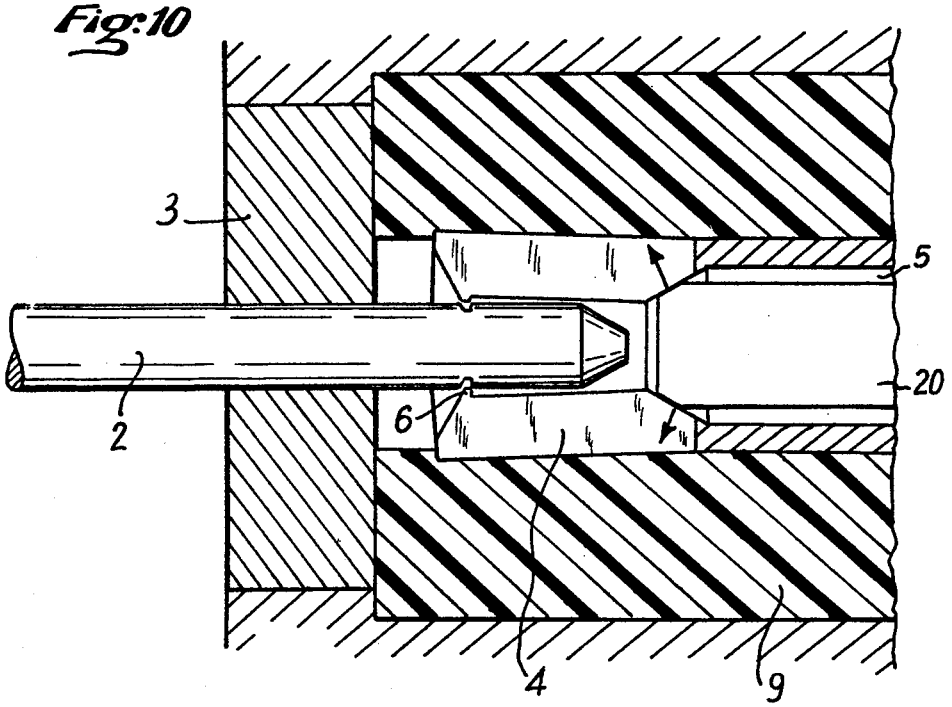
FIG. 10 shows the disassembly of the central contact of a connector element according to the invention.

Referring now to FIG. 10, which shows schematically the operation for extracting a central contact 4. This is achieved by inserting from the rear into the longitudinal hollow 5 of the central contact 4 a tool 20 shaped to open radially outwardly, as shown schematically by the arrows in FIG. 10, the tip of the central contact 4 in order to force the shoulder 6 off its impression in the rod 2 or off its groove 13 which may be provided in this rod. All that remains to be done to extract the central contact 4 is to pull on its rear tip.

While particular embodiments of the invention have been shown, it will be understood, of course, that the invention is not limited thereto since many modifications may be made, and it is therefore contemplated to cover by the appended claims any such modifications as fall within the true spirit and scope of the invention.

What is claimed is:

1. A coaxial connector element comprising a tubular body having an internal cavity an axial rod secured against axial motion in said body by a bead made from dielectric material, said axial rod protruding from the tip of said body closed by said bead, and a central contact having an axial hollow for its engagement around said rod within said body, an insulator between said central contact and the wall of said cavity in said body, said central contact having near its tip, engaged in said axial rod, an annular shoulder which protrudes inwardly into the axial hollow provided on said central contact, and said central contact having its tip slotted, adjacent said annular shoulder, with a plurality of longitudinal slits which confer a radial elasticity thereon to permit said shoulder to pass over said rod and penetrate into said rod.

2. The coaxial connector element as set forth in claim 1, wherein said axial rod has an annular groove for receiving said shoulder.

3. The coaxial connector element as set forth in claim 1, wherein said shoulder of said central contact is overlaid in said axial rod.

4. The coaxial connector element as set forth in claim 1, wherein said bead is glass.

5. A coaxial connector element comprising a tubular body having an internal cavity, an axial rod secured against axial motion in said body by a bead made from dielectric material, said axial rod protruding from the tip of said body closed by said bead, and a central contact having an axial hollow for its engagement around said rod within said body, an insulator between said central contact and the wall of said cavity in said body, said central contact having near its tip, engaged in said axial rod, an annular shoulder which protrudes inwardly into the axial hollow provided on said central contact, said annular shoulder penetrating into said rod, and wherein said shoulder is positioned at the bottom of a chamfer of the tip face of said central contact.

6. A coaxial connector element comprising a tubular body having an internal cavity, an axial rod secured against axial motion in said body by a bead made from dielectric material, said axial rod protruding from the tip of said body closed by said bead, and a central contact having an axial hollow for its engagement around said rod within said body, an insulator between said central contact and the wall of said cavity in said body, said central contact having near its tip, engaged in said axial rod, an annular shoulder which protrudes inwardly into the axial hollow provided on said central contact, said annular shoulder penetrating into said rod, and wherein said shoulder is obtained by machining or by chasing.

* * * * *